US005704886A

United States Patent [19]

Sampaolo et al.

[11] Patent Number: 5,704,886

[45] Date of Patent: Jan. 6, 1998

[54] METHOD AND APPARATUS FOR SCORING PAPERBOARD PACKAGE SHEETS

[75] Inventors: Guido Sampaolo, Cary; David Scott Wynne, Raleigh, both of N.C.; Robert Tanczos, Cedar Rapids, Iowa

[73] Assignee: International Paper Company, Purchase, N.Y.

[21] Appl. No.: 459,123

[22] Filed: Jun. 2, 1995

[51] Int. Cl.[6] ..... B31B 1/16; B31B 1/25; B26D 1/22

[52] U.S. Cl. ..... 493/60; 493/62; 493/399; 493/402; 493/404; 83/37; 83/345; 83/885

[58] Field of Search ..... 53/456, 558, 389.3, 53/460, 563; 493/59, 60, 61, 62, 396, 397, 398, 399, 400, 401, 402, 403, 404; 83/37, 345, 885

[56] References Cited

U.S. PATENT DOCUMENTS

| | | | |
|---|---|---|---|
| 136,246 | 2/1873 | Jaeger . | |
| 308,624 | 12/1884 | Morgan | 493/402 |
| 549,064 | 10/1895 | Gay . | |
| 659,246 | 10/1900 | Mayall . | |
| 725,863 | 4/1903 | McMillin . | |
| 758,672 | 5/1904 | Mayall | 493/396 |
| 944,536 | 12/1909 | Bonfield et al. | 493/396 |
| 946,393 | 1/1910 | Nichols . | |
| 1,482,569 | 2/1924 | Lange | 493/401 |
| 1,777,285 | 10/1930 | Adsit | 493/60 |
| 1,798,475 | 3/1931 | Lange | 493/403 |
| 1,970,029 | 8/1934 | Brunner et al. . | |
| 2,048,684 | 7/1936 | Carr | 493/403 X |
| 2,292,403 | 8/1942 | Peters . | |
| 2,364,342 | 12/1944 | Bruker | 493/402 X |
| 2,751,136 | 6/1956 | Moore . | |
| 3,082,583 | 3/1963 | Larson et al. . | |
| 3,237,838 | 3/1966 | Elias . | |
| 3,314,339 | 4/1967 | Guffy et al. . | |
| 3,355,969 | 12/1967 | Sarka . | |
| 3,717,074 | 2/1973 | Rasmussen . | |
| 3,727,825 | 4/1973 | Troth . | |
| 4,078,715 | 3/1978 | Larsson et al. . | |
| 4,287,247 | 9/1981 | Reil et al. . | |
| 4,559,259 | 12/1985 | Cetrelli . | |
| 4,586,643 | 5/1986 | Halabisky et al. . | |
| 4,586,650 | 5/1986 | Sasaki et al. . | |
| 4,588,122 | 5/1986 | Lisiecki . | |
| 4,589,863 | 5/1986 | Hodges | 493/60 X |
| 4,657,175 | 4/1987 | Martensson . | |

(List continued on next page.)

FOREIGN PATENT DOCUMENTS

| | | |
|---|---|---|
| 319455 | 3/1902 | France . |
| 686502 | 1/1940 | Germany . |
| 15434 | 11/1886 | United Kingdom . |
| 251579 | 5/1926 | United Kingdom . |
| 372624 | 6/1932 | United Kingdom . |

*Primary Examiner*—Horace M. Culver
*Attorney, Agent, or Firm*—Luedeka, Neely & Graham, PC

[57] ABSTRACT

A container and corresponding blank from which such container is formed is particularly suitable for packaging liquid products and aseptically packaging liquid foods. The rectangular shaped blank may be formed of a laminated sheet material that preferably includes a composite of paperboard web, aluminum foil and intermediate layers of heat sealable polymer. All blank fold lines are scored and an induction sealing flange area is provided around the entire blank perimeter. A unit of several sheet linked blanks is symmetrically folded about a central axis for juxtaposed alignment of sealing flange area around the perimeter of the unfolded blank. After induction sealing, the package side flange at the bottom of the unit, the resulting tube pocket is open and charged with a material quantity of liquid. After charging, the series of edge flanges above the first sealed edge flange are also induction sealed and severed from the unit remainder to complete a pillow shaped package. With fluid contents encapsulated, the pillow-shaped package includes a standing flange seam around three of four edges. The pillow corners are collapsed along diagonal corner score lines to triangular gable points and the side and ends of the pillow mechanically erected to orthographic planes with the standing seams and corner gable points folded flat against an adjacent plane.

14 Claims, 8 Drawing Sheets

U.S. PATENT DOCUMENTS 4,715,847 12/1987 Focke et al. ..... 493/60 X
4,740,163 4/1988 Kuchenbecker .
4,795,084 1/1989 Hartman .
4,795,086 1/1989 Farber ..... 493/59 X
4,819,861 4/1989 Nagata .
4,820,253 4/1989 Mercurio ..... 493/59
4,828,539 5/1989 Jonsson et al. .
4,834,823 5/1989 Reil .
4,909,432 3/1990 Nagata .
4,931,031 6/1990 Lisiecki .
5,138,923 8/1992 Kent et al. .
5,158,816 10/1992 Rausing .
5,337,538 8/1994 Ljungstrom ..... 53/456

METHOD AND APPARATUS FOR SCORING PAPERBOARD PACKAGE SHEETS

BACKGROUND

The present invention relates to a paperboard package of the parallelepiped configuration suitable for the consumer distribution of aseptically packaged liquid food products, and to an apparatus and associated method for producing scored blanks and packages made from such blanks.

The laminated paperboard parallelepiped package configuration is well established for marketing small consumer quantities of beverages and liquid foods. These packages are fabricated from a sheet material comprising a laminated composite having a paperboard substrate base and at least two layers of hot melt applied thermoplastic polymer such as polyethylene, PET or polypropylene, often with an interior metal foil layer such as aluminum. Packages of this construction typically are both gas and light impermeable. If assembled from sterile materials or materials that are sterilized after assembly and filled with sterile contents under sterile conditions, these packages, known as aseptic, are designed to insure that the contents may be safely consumed after storage for extended time periods without refrigeration.

Commercial sterility in the food packaging field is, therefore, that state or condition where a product, its package and associated filling and handling equipment are substantially free of harmful microorganisms capable of reproducing in the package confined food under normal, nonrefrigerated conditions of storage and distribution. Additionally, the product and its package are substantially free of viable microorganisms, including spores, of public health significance. Process conditions compatible with commercial sterility in low acid foods such as milk, cream, yogurt and vegetable juice include heating to the order of at least 140° C. for at least 6 seconds. At the other end of the spectrum, high acid foods may require heating to only 93° C. for about 15 seconds to achieve commercial sterility.

The paperboard substrate for these packages provides structural strength and rigidity to the composite and an excellent print surface for graphics. Consequently, a sealing layer of polymer is applied to the side of the paper to be used as the package interior and, while still hot and viscous, a layer of aluminum foil is applied onto the polymer film. The foil provides a sealing barrier against all gases and light. A second polymer layer most suitable for direct contact with the package contents is then applied over the foil.

In most cases, the base sheet lamination also receives a coating of polymer on the exterior surface of the paperboard applied over the graphics for external moisture protection of the paperboard, and scratch protection for previously applied graphics. Such a sequence is not exclusive, however, since there are marketing and production circumstances under which the graphics are applied over the exterior polymer coating. The base sheet lamination and fabrication processes referred to are normally practiced upon a continuously running sheet material drawn from a reel supply and rewound as a reel to become reel supply on another processing machine such as a printing machine. In the case of multiple color printing, each color in a complete composition may be applied at a separate print section. Register mechanisms along the sheet route through the machine regulate the running material position relative to each print station. The result is a repeating continuum of package blank graphics repetitively distributed along the reeled material length.

A folding score is typically applied in registry with the pattern of package graphics on the base sheet continuum of package blanks. Scores are channels or grooves pressed or embossed into the base sheet which delineate integrally adjacent panel areas of a package to be formed by folding a sheet of construction material. These scores facilitate folding and bending of the blank in erection of the container and therefore also delineate the boundaries of adjacent panel areas in the finished product.

Longitudinal score lines may be continuous or interrupted and oriented parallel with the web or base sheet running direction. This would also be parallel to the paper web machine direction (M.D.) which is the longitudinal or continuous running direction of the paper web as it was made. Such longitudinal score lines are typically embossed into a running web or laminated base sheet in the nip of a pair of scoring cylinders, one of which has a projecting ridge or ridges around its circumference and the other of which may be flat (anvil cylinder) or contain a groove around its (female cylinder) circumference which rotatably mates in spaced relation with the ridge on the male cylinder. As the web runs longitudinally through the cylinder nip, the male cylinder ridge and female or anvil cylinder pressingly engage the web therebetween to emboss a groove or score into the web.

Transverse or diagonal score lines of finite length may also be embossed between a pair of die cylinders in which a protruding ridge on a male cylinder meshes with a channel indentation on a female cylinder or is disposed in nip association with a co-rotating anvil cylinder.

Conventionally, all the protruding die ridge elements are positioned on one cylinder of a nip combination and any cooperative channels are positioned on the other cylinder. Generally, folded paperboard carton fabrication allows corner folds to be sharply turned over anvil cylinders or hard edges. In the case of aseptic, parallelepiped carton fabrication, however, the corners are typically not sharply broken or completed along any fold or score lines before the package is filled and sealed. Thus, the container may be filled as a rolled tube having its lateral edges sealed upon one another, often with a lapped closure and the leading end sealed in a similar manner. After the contents are inserted, the other end of the tube may be crimp or lap sealed to complete a fluid filled, flexible wall, pillow-like configuration. From this geometry, a parallelepiped shape may be formed by external shaping pressure surfaces to mold the pillow about the creased score lines. Resultantly, the package corners are generally softly rounded rather than crisp and sharp.

Due to the number and thickness of laminations required of aseptic package construction, effective scoring requires die nip pressure. Additionally, when the package closure folds are made, the corner pressures are compounded due to the doubling and redoubling of the sheet thickness about the fold line. As a consequence, the web preparation and packaging processes must be tightly controlled, and even slight deviations may result in rejection of packages due to foil or paperboard ruptures that occur during the folding or filling process.

It is, therefore, an object of the present invention to provide a parallelepiped package construction forming method and associated apparatus which imposes less compressive and tensile stresses on the package corners and edges.

Another object of the present invention is a method and associated apparatus for scoring package blanks which facilitates erection of the finally folded shape of the package according to the intended fold angle of adjacent panels so as to provide desired edge or corner characteristics.

A further object of the present invention is provision of a paperboard parallelepiped package having two opposite face surfaces and a linking end surface which are uninterrupted by seams or joints.

A further object of the invention is to provide a package blank, package configuration, and method and apparatus for making package blanks and packages from blanks which are relatively uncomplicated and convenient to make and use.

SUMMARY

With regard to the above and other objects, the invention provides a parallelepiped package for fluid contents that is fabricated from a laminated assembly of paperboard sheet, aluminum foil and polymer film. A multiplicity of surface panels are defined and delineated in a package blank by score lines. The internal package volume is enclosed by folding such surface panels about said volume. The package end panels are formed with multiple laps of the laminated sheet into substantially triangular end closures. These triangular end closures are folded about score lines that are offset from a corresponding end corner connecting line. This offset is in the direction the triangular end closure laps against a side or end surface of the parallelepiped.

Another feature of the present invention is a liquid container having substantially rectangular opposite end walls, side walls and face walls formed from a substantially rectangular composite sheet. This rectangular composite sheet comprises a paperboard substrate that supports at least one coat of lamination polymer to an inside surface of the paperboard. The rectangular sheet blank has a perimeter that comprises substantially parallel side edges and end edges. Around the perimeter is a flange area delineated by folding creases scored into the sheet surface. Each of the container end walls, side walls and face walls are delineated by folding crease scores. In addition, a construction score line is creased into the sheet along a position substantially bisecting the length of the sheet between parallel side edges. One of the container end walls is symmetrically disposed about the construction score line. Container face walls that adjacently flank the first end wall project in opposite direction from the first end wall along directions parallel with the side edges. When the sheet is folded about the construction score line, a juxtaposed length of flange area along the side edges is aligned for mutual heat bonding of the polymer coating. That area of the container corresponding to the side walls and the other end wall is substantially equally divided between opposite sides of the construction score line. This divided side and end wall area is delineated between the perimeter flange and the front and back face walls.

According to an additional aspect of the invention, scoring die cylinders disposed in a continuous web forming and product filling apparatus and process are fabricated to emboss a mixture of folding score bias to opposite faces of a planar web in a single score nip established between the cylinders to predispose a corresponding mixture of fold lines in the web toward folding in opposite directions. After the package is filled and sealed, external pressure surfaces are assisted by the score bias with the folding occurring with or against the bias to mold crisp, sharp corners and edges from the pillow form package.

According to a further aspect of the invention, an apparatus is provided for scoring an elongated web containing a plurality of package blanks wherein each blank is to include within its boundaries a plurality of score lines to assist in folding the blank into a parallelepiped container. The apparatus comprises a pair of counter-rotating scoring cylinders supported adjacent to one another so as to provide a nip therebetween wherein the web is compressively engaged and pulled through the nip by rotation of the cylinders, and means for supporting the cylinders in nip association and for inducing rotation of the cylinders. Each of the first and second scoring cylinders includes at least a pattern of male and female elements which are dimensioned and arranged so as to be in meshing register adjacent the nip with corresponding female and male elements, respectively, on the other cylinder, wherein the meshing registry of a male element on the first cylinder with a female element on the second cylinder adjacent the nip produces a first score line on the web within the boundaries of a blank score line in the nature of a depression on the surface of the web within the blank adjacent the first cylinder and a folding bias within the blank along the first score line in the direction of the surface of the web adjacent the first cylinder, and the meshing registry of a female element on the first cylinder with a male element on the second cylinder adjacent the nip produces a second score line on the web within the boundaries of the same blank in the nature of a depression on the surface of the web within the blank adjacent the second cylinder and a folding bias within the blank along the second score in the direction of the surface of the web adjacent the second cylinder, whereby each blank in the web, after passage through said nip, includes within its boundary at least a pair of score lines biased to fold in generally opposite directions. The male and female elements on each of the cylinders which define the first and second score lines within the blank are preferably spaced apart so as to define at least a short transition zone of substantially undeformed material therebetween, and may be parallel, collinear, perpendicular, at an acute or obtuse angle with respect to one another, or in any desired spatial relationship in accordance with the desired arrangement of score or fold lines in the blank to enable erection of the parallelepiped container. Thus, for preparation of a blank for a container with gable or triangular fold-down end flaps, for example, adjacent male and female elements on the first cylinder arranged end-to-end at about the predetermined angle with respect to one another and in meshing register with corresponding female and male elements on the second cylinder may be used to define the adjacent fold lines as adjacent oppositely biased fold lines arranged in spaced-apart end-to-end relation at about the predetermined angle with respect to one another to assist in folding the blank in the desired manner to provide the end flaps while minimizing undue stress or compression of the material adjacent the fold lines, thus avoiding unintended loss of the aseptic condition of the container interior due to a rupture of the material associated with compression or stress-induced weakening of the material.

Following the scoring die section of the continuous web processing sequence of the invention, the web is routed into a sterilization section. An applicator roll applies a film of hydrogen peroxide solution to the inside (product contacting) surface of the web. From the applicator roll, the web is routed into contact with the heated surface of a rotating sterilization drum.

From the sterilization section, the continuous web travel flow is drawn upwardly into a folding tower to be folded longitudinally about a bisecting axis. At the tower top, the folded web is drawn tightly over crown roll elements to turn the web traveling direction downwardly. In a down-traveling orientation, juxtaposed web edges opposite from the bisecting fold line are induction-sealed together to form a fluid tight tube below the induction-sealing point. Immediately above the induction-sealing point, however, fluid conduits respective to liquid product and sterilization gas are routed between the open leaves of the folded web and terminated below the induction-sealing point.

With a continuously replenished, standing column of liquid product in the tube provided by the product fluid conduit, a shuttle bar mechanism pinches the tube section to isolate a predetermined volume of liquid product between a heat sealed flange below the isolated volume and the standing column of liquid above the isolated volume. While pinched together, induced current within the laminated foil heats the pinch contiguous area to fuse the interior polymer coating within the pinched area. With this, the tube is severed along the mid-span of the induction sealed area under the cutoff knife to provide a heat sealed side flange to the completed carton that falls away from the tube column above and the same for incomplete carton that remains as the sealed bottom of the liquid product column.

A completed and severed carton is a pillow shaped article having a standing, induction sealed seam along two sides and an end. This pillow falls into a forming pocket on a short conveyor belt to be formed by molding surfaces into the familiar parallelepiped shape with the pillow corners folded crisply to triangular gable points. Preferably, the carton top end gable points are further folded flat against the carton side and heat sealed in place. The carton bottom end gable points are further folded flat against the carton bottom face and heat sealed in place.

DESCRIPTION OF THE DRAWINGS

The above and other features and advantages of the invention will now be described in further detail in conjunction with the drawings, in which.

PREFERRED EMBODIMENT OF THE INVENTION

Figure 1:
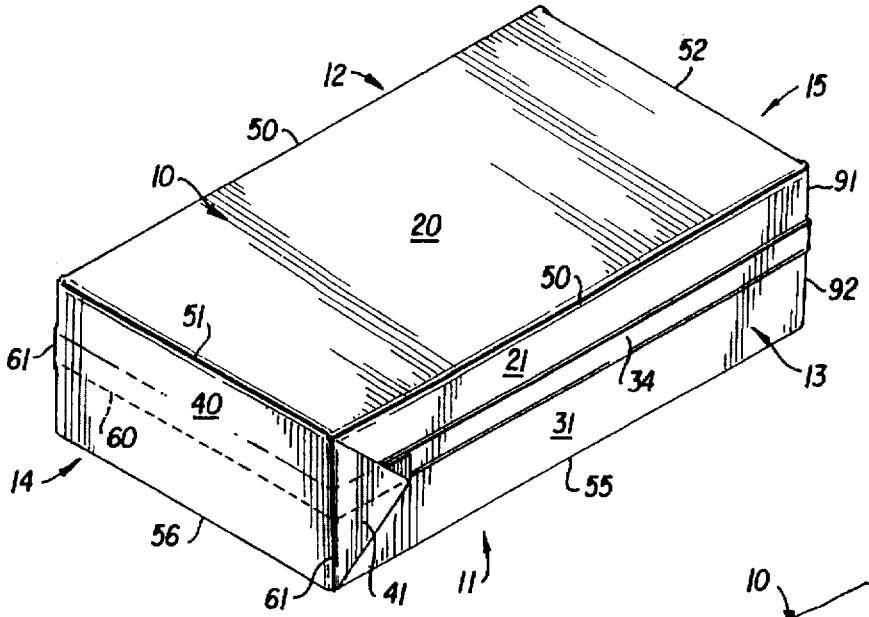
FIG. 1 is a pictorial view of a paperboard parallelepiped package according to one embodiment of the present invention.

Referring now to the drawings wherein like reference characters designate like or similar elements throughout the several views, a preferred embodiment of the present invention includes the paperboard parallelepiped package illustrated by FIGS. 1, 2 and 3 and an associated scored blank, method and apparatus for making the same to be described more fully hereinafter. Features of the package include a front face 10, a back face 11, a right side 12, a left side 13, a top end 14 and a bottom end 15. Referring to FIG. 3, the package wall construction is shown to include a laminated composition of paperboard substrate 120, a thermoplastic tie layer 121, a gas and moisture barrier layer such as aluminum foil 122, another aluminum interface tie layer not shown for laminating to the moisture barrier layer surface an inner layer of thermoplastic polymer 123 such as polyethylene that is appropriate for direct contact with the food contents of the package. To the outer surfaces of the paperboard substrate 120 a layer of polymer 124 is applied to resist penetration of water into or through the paperboard and to protect sales graphics if previously applied.

Figure 2:
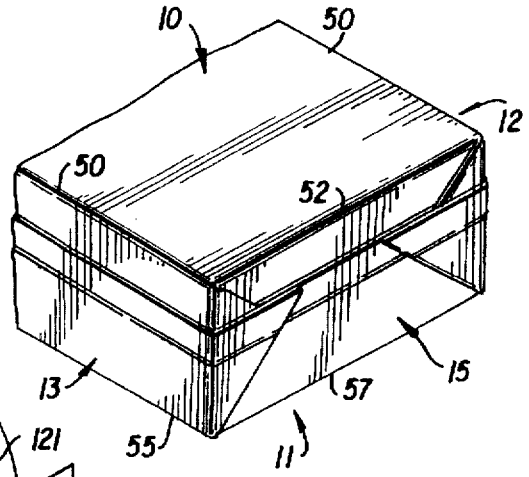
FIG. 2 is an end view of the package depicted in FIG. 1.
Figure 3:
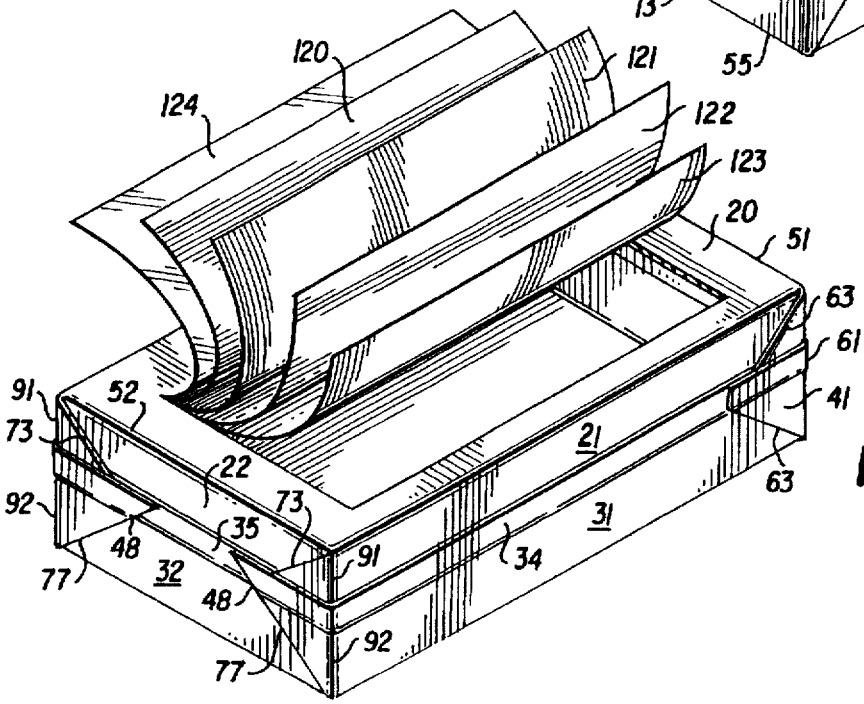
FIG. 3 is a pictorial view of a parallelepiped aseptic package illustrating a lamination sequence for the fabrication of a multilayer web for use in the invention.
Figure 14:
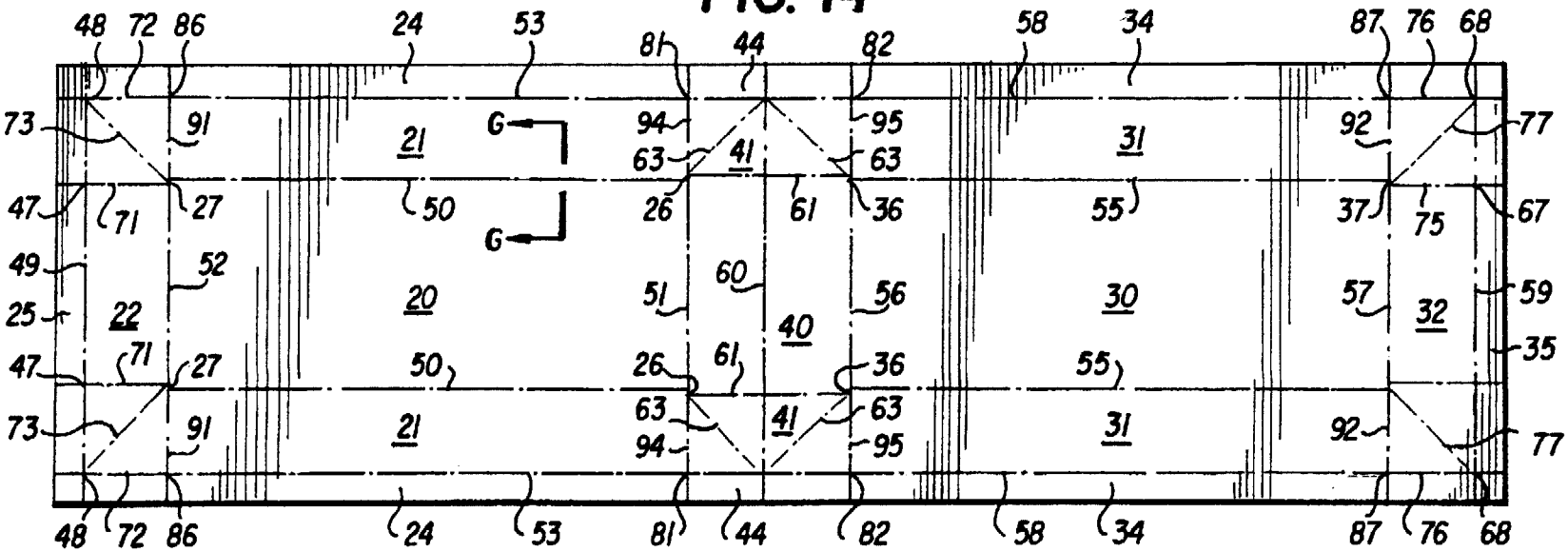
FIG. 14 is the plan of a scored folding blank for forming a package incorporating the present invention.

The finished package illustrated by FIGS. 1 and 2 is erected from the folding blank shown in FIG. 14 which is derived from a longitudinal section of web having a laminated composition such as described above. To emphasize, the packages of FIGS. 1 and 2 are not folded from individual blanks but are formed by a continuous web process sequence. Descriptive clarity of that web process sequence is merely facilitated by a folded blank analogy.

Characteristically, the invention folding blank includes no slits or slots. In addition to printed graphics or indicia applied to the outer surface of the blank, the blank includes folding score lines. Centerfold score line 60 substantially bisects the greater length dimension of the blank and is the axis about which the front half of the blank is folded in face-to-face juxtaposition as may be perceived from the pictorials of FIGS. 4 and 5.

Figure 4:
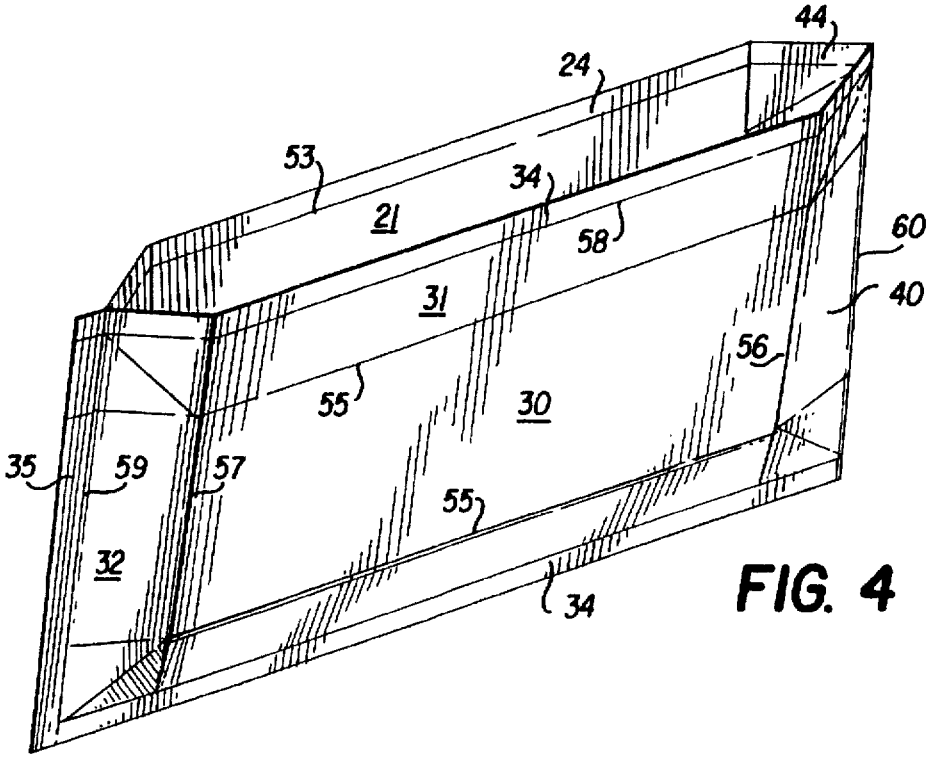
FIG. 4 is a pictorial view of a partially completed, parallelepiped package according to an embodiment of the invention having an open, un-folded side.
Figure 5:
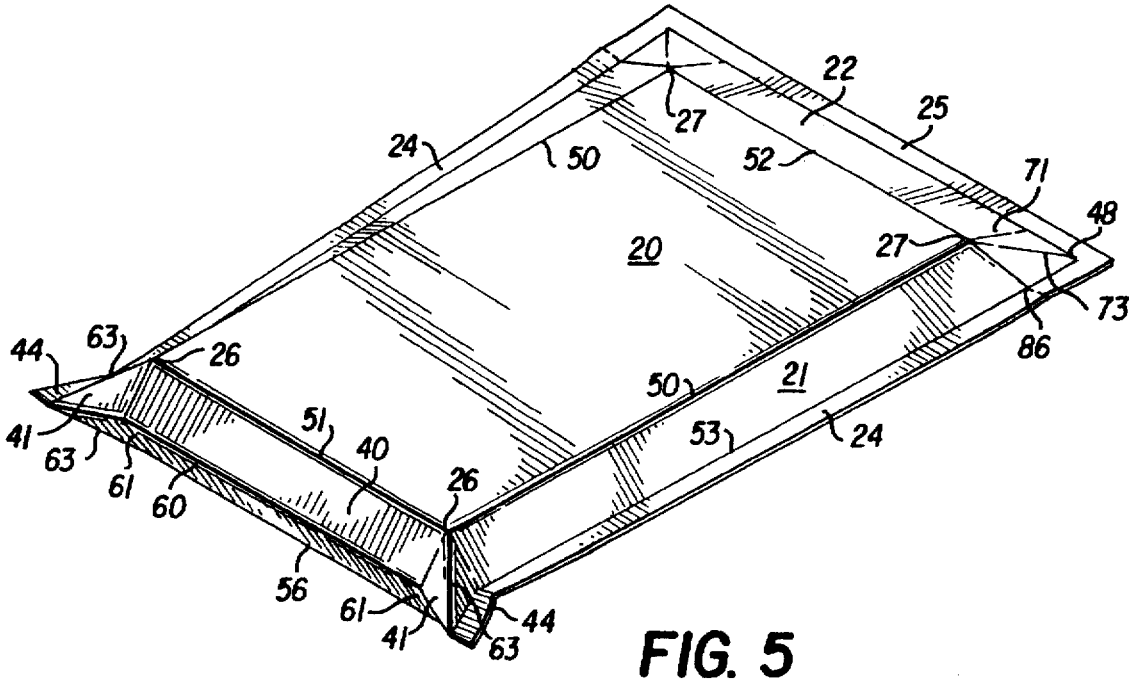
FIG. 5 is a pictorial view of the packages of FIG. 4 with the open ends sealed closed and ready for folding gable end flaps to provide the flat-bottomed container of FIG. 1.

Around the blank perimeter is a narrow sealing border flange 24, 25, 34, and 35. As best illustrated by FIGS. 4 and 5, the respectively contiguous inside surfaces of this flange are heat sealed together thereby forming the basic structure from which the open pocket shown by FIG. 4 is erected. It should be noted that when the pocket is closed, the flanges are turned outward about delineating score lines 53 and 58 to form an inside corner. The scoring dies by which the blank is fabricated are consequently oriented to bias a corresponding fold along these score lines to the outwardly turned angle.

Symmetrically distributed laterally of the centerfold line 60 is the top panel area 40 delineated by score lines 51, 56 and 61. When turned, score line 51 will define the top front corner edge of the completed package. Similarly, score line 56 will define the top rear corner edge. In like manner, the two score lines 61, respectively, define the right and left top side corner edges. Note should be taken that the score lines 61 are not in axial alignment with the long front and back face corner score lines 50 and 55. More will subsequently be developed about this distinction. Note should also be taken of the fact that centerfold line 60 does not define an erected corner of the package.

Moving down from the top front corner 51, front panel 20 is delineated by longitudinal side score lines 50 and bottom front score line 52. Similarly, back panel 30 is delineated by the top back corner 56, longitudinal side score lines 55 and bottom back score line 57. Since all of these front and back face score lines are folded to outside corners, the fabricated dies are prepared accordingly.

Right and left long side walls 12 and 13 of the finished package are the fabricated assembly product of half width side panels 21 and 31 joined along the flange areas 24 and 34. Likewise, half width bottom panels 22 and 32 joined along seal flange areas 25 and 35 combine to fabricate the bottom end 15. Bottom flange delineating score lines 49 and 59 respective to the front and back panels are fabricated to bias an inside corner.

Figure 17:
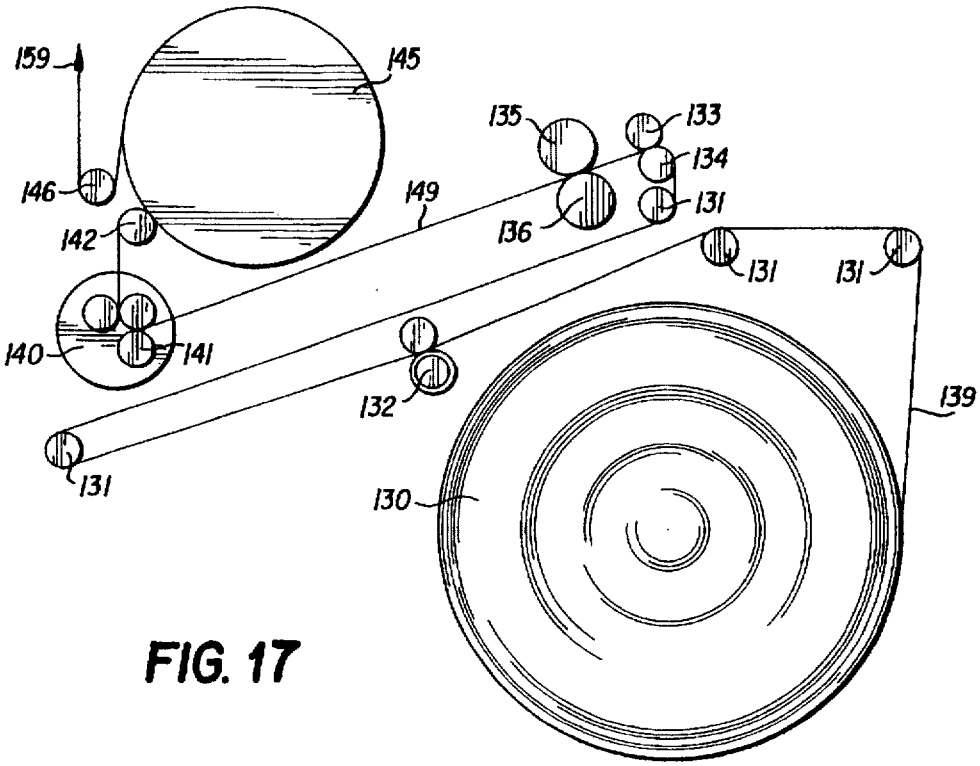
FIG. 17 is a web routing schematic for the scoring and sterilizing section of the forming and filling machine of the present invention.
Figure 16:
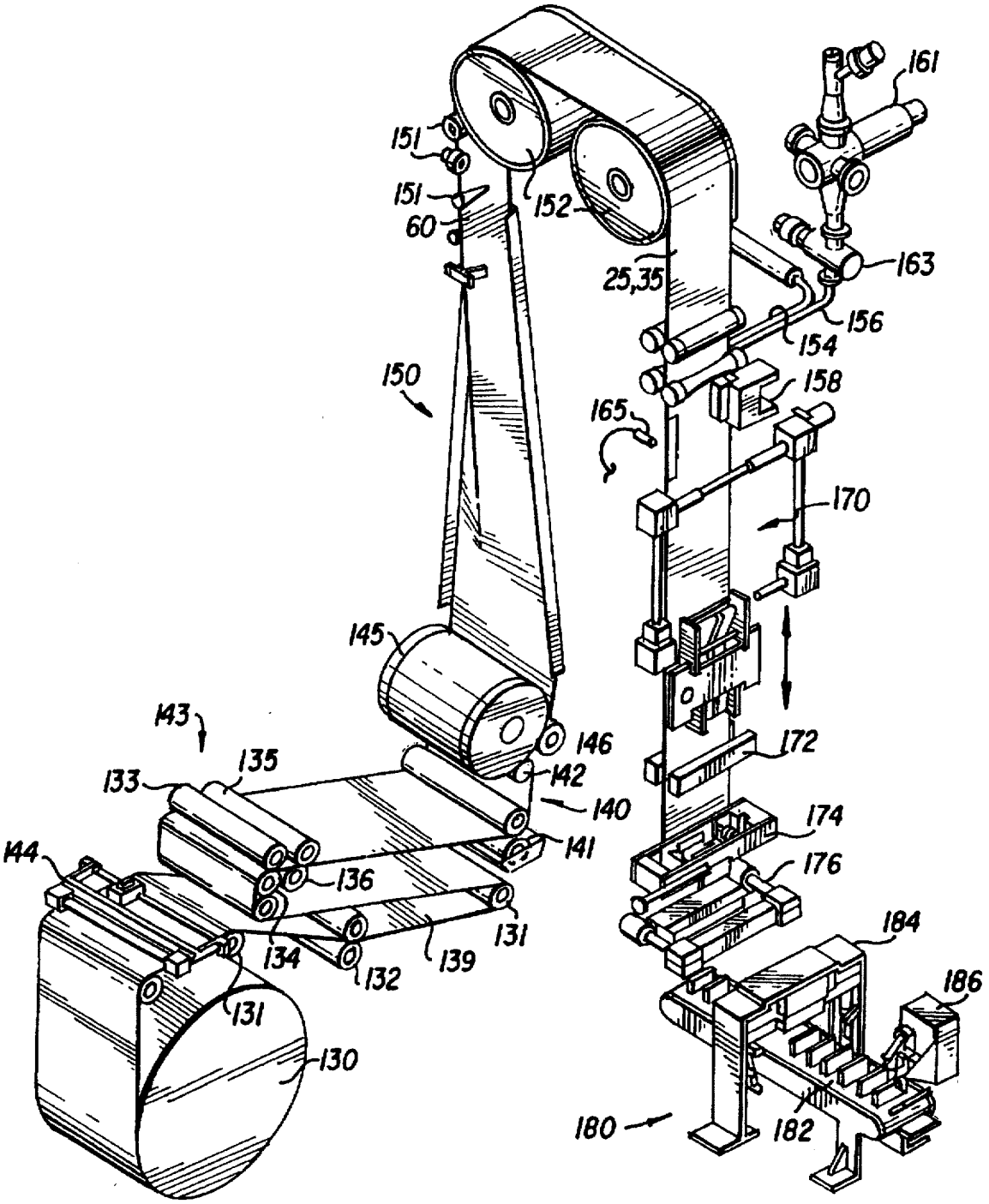
FIG. 16 is pictorial schematic of a continuous forming and filling machine for practicing the invention.

With respect to the material processing schematics of FIGS. 16 and 17, pre-printed sheet material 139 is drawn by a powered sterilization roll 145 from a supply reel 130 over idler rolls 131 and through a splicing mechanism 144. In registry alignment with the preprinted sheet graphics and indicia, the web enters a scoring section 143, first receiving the MD score lines 49, 51, 52, 56, 57, 59 and 60 from nipping cylinder sets 133 and 134. Except for the bottom and sealing flange scores 49 and 59, these scores are oriented to bias an outside corner. Hence, a scoring cylinder ridge is nipped into the side of the running reel material that will be the inside of the package.

The remaining scores in a blank package are applied in a register controlled nip between the die cylinder set 135 and 136 having ridges with cross-directional (CD) components on one cylinder mesh with corresponding CD grooves on a mating cylinder. It should be specifically noted that neither cylinder is restricted to ridges or grooves exclusively. Ridges and grooves may be on the same cylinder with the mirror opposite mixture on the cooperatively mashing cylinder. Preferably, the cylinder diameter is a whole number function of the blank machine direction (MD) dimension. In the present example illustrated by FIGS. 6 and 7, a meshing pair of die cylinder surfaces are represented as rolled flat to reveal the score line pattern for making three contiguous and identical folding blanks for each jointly nipped rotation of the cylinders 135 and 136. These blanks will be subsequently separated by cross-cuts along the partition lines 117/217, 118/218 and 119/219 but not until the respective package is filled with product and sealed as will be subsequently explained. The MD scores in the preprinted web supply are applied by cylinders 133/134 having scoring features that extend continuously around the cylinder circumferences. These cylinders 133/134 are driven at a slightly slower rotational speed than the sterilization drum 145 thereby imposing a tensile stress in the web between the cylinder nip and drum. The features having CD length components are applied by cylinders 135/136. However, these CD scoring features extend around only part of the cylinder 135/136 circumferences. Consequently, if scoring cylinder set 135/136 were located ahead of scoring cylinder set 133/134, web tension between the two cylinder sets would continuously fluctuate.

Another normal consequence of the closely linked scoring nips respective to cylinders 133/134 and cylinders 135/136 is the generation of tensile stresses in the processed sheet material due to registration control over the web. Registration adjustments are made by a relative displacement, advance or retard, as needed, between the die cylinder set 135/136 nip position and the in-running sheet. If there is continuous CD nip contact around the die cylinder perimeter, large tensile forces are imposed on the sheet to move it under the engaged die elements. With the present invention, however, it will be noted that no CD die elements engage the sheet as the nip of die cylinders 135/136 progresses over the cylinder surface perimeter delineated by the circumferential arc segment between the successive scoring elements 101, 103, 105 and 107 of FIG. 6 or the successive elements 201, 203,205 and 207 of FIG. 7. While the CD die cylinder nip is located within such an arcuate, register correction increment of the sheet length, register adjustments may be accomplished with relatively little sheet tension increase or risk of scarring the preprinted graphics.

Figure 6:
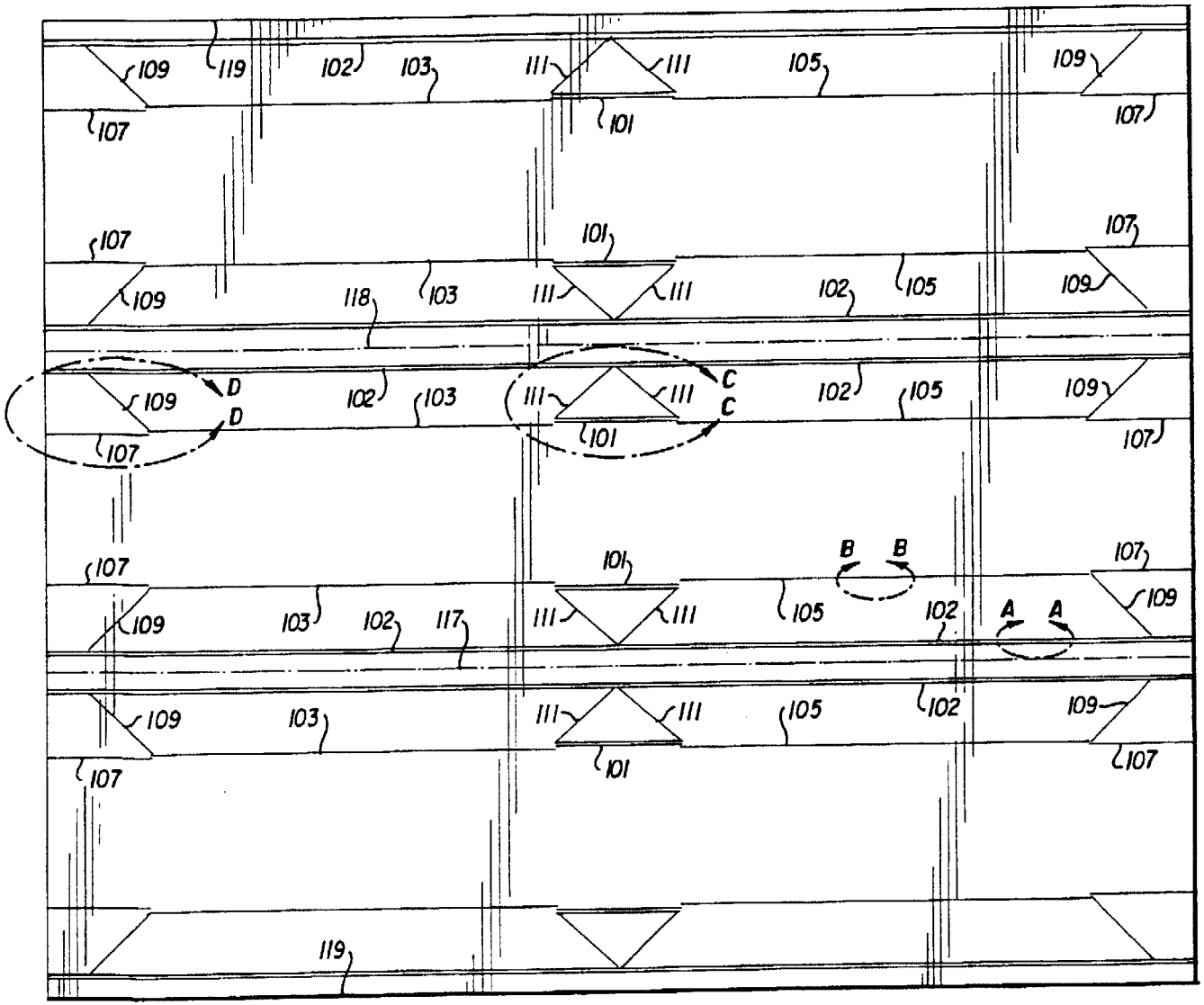
FIG. 6 is planar development of the die element pattern for the bottom roll of the rotary die set incorporating the present invention.
Figure 7:
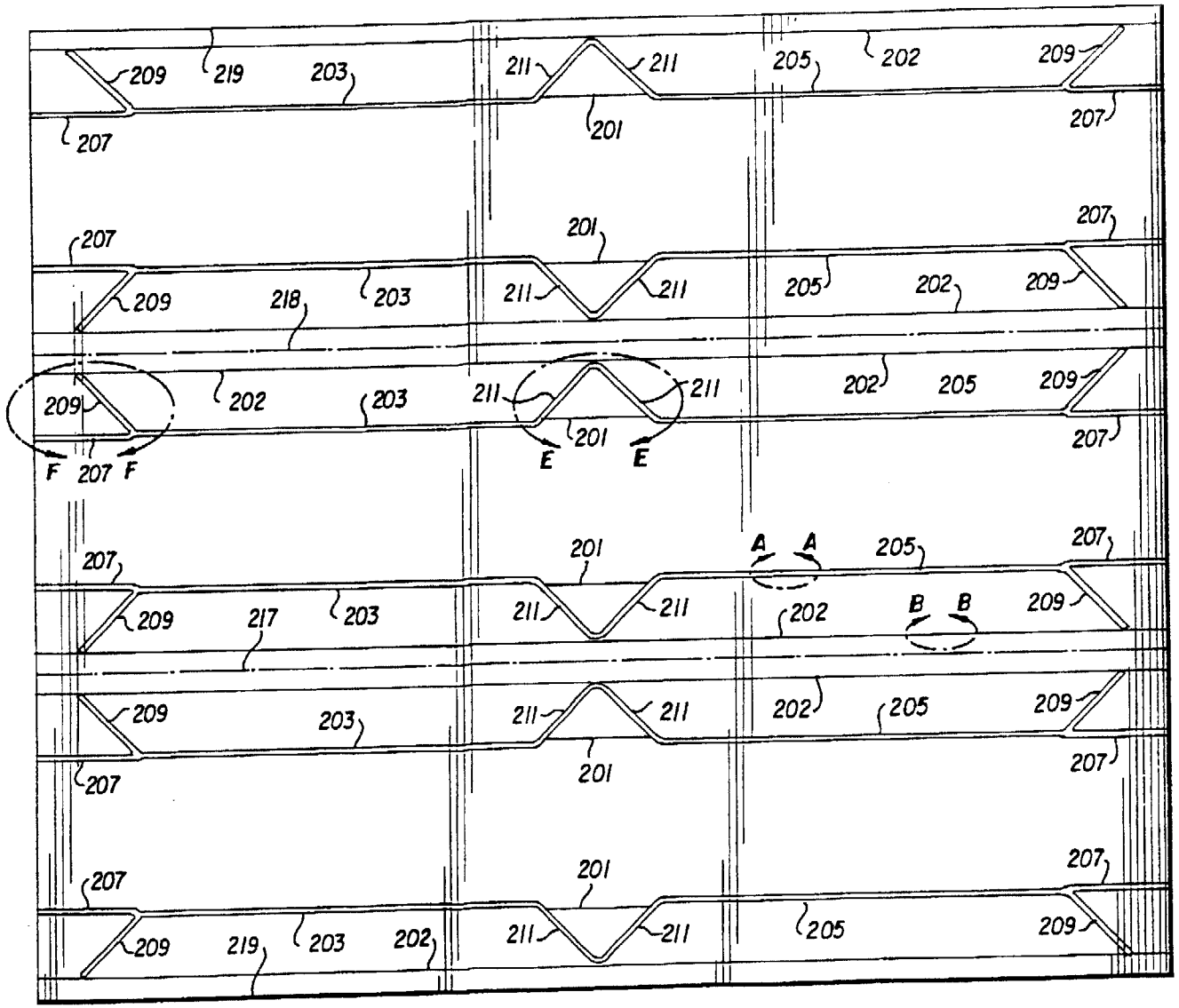
FIG. 7 is a planar development of the die element pattern for the top roll of the rotary die set incorporating the present invention.
Figure 15:
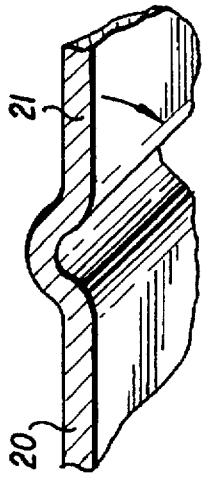
FIG. 15 is an enlarged cross-section of a folding blank viewed along the score line 50 at the cutting plane G—G of FIG. 14.
Figure 9:
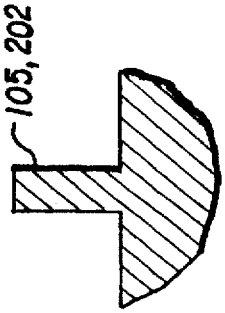
FIG. 9 is an enlarged detail of the circumscribed area B of FIGS. 6 and 7 showing a male scoring die ridge.
Figure 8:
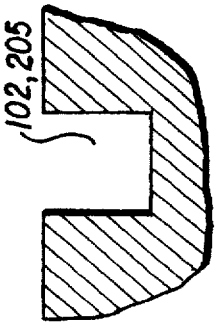
FIG. 8 is an enlarged detail of the circumscribed area A of FIGS. 6 and 7 showing a female scoring die channel.

Additional characteristics of the die pattern to be noted include the representation by FIGS. 6 and 7 of ridges or rule edges as a single broad line and meshing receptacle grooves as a pair of finer, closely spaced parallel lines. The die channels 102/205 respective to FIGS. 6 and 7 at detail arc A are illustrated in enlarged cross-section by FIG. 8. Die ridges 105/202 at detail area B are illustrated in enlarged cross-section by FIG. 9.

Also to be noted is that the bottom die cylinder 136 represented by the planar projected development of FIG. 6 is the substantial mirror opposite of meshing top cylinder 135, developed by FIG. 7 in which those structures shown as die ridges on FIG. 6 are die grooves on the cylinder 135 of FIG. 7 and vice versa.

In the preferred embodiment of the invention, the die cylinder structure of FIG. 6 will be applied against the inside surface of the blank material whereby the ridge structures 103 and 105, for example, emboss channels in the sheet material with interior facing concavities.

Figure 11:
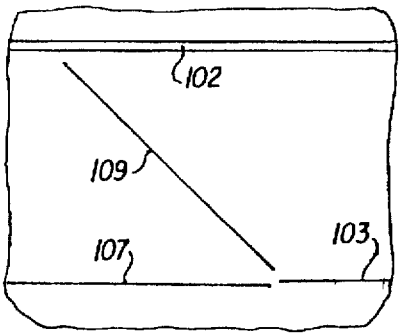
FIG. 11 is an enlarged detail of the circumscribed area D of FIG. 6.
Figure 10:
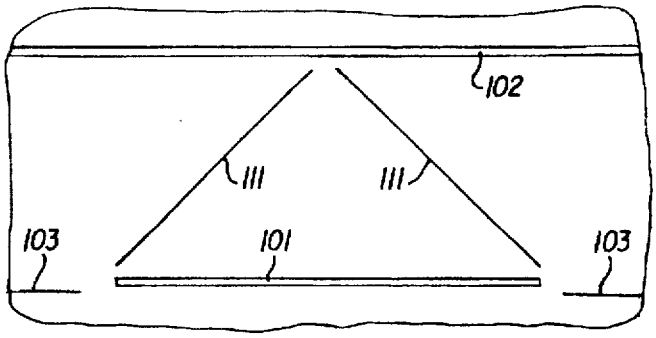
FIG. 10 is an enlarged detail of the circumscribed area C of FIG. 6.
Figure 13:
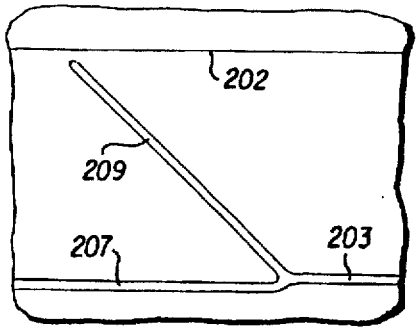
FIG. 13 is an enlarged detail of the circumscribed area F of FIG. 7.
Figure 12:
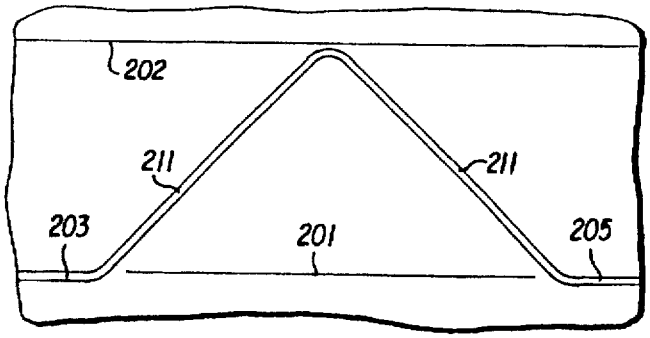
FIG. 12 is an enlarged detail of the circumscribed area E of FIG. 7.

It is a feature of the present invention that both ridge and channel die elements are provided in essentially the same cross-direction (CD) line across the blank material. With regard to FIG. 10 which portrays an enlarged detail of the FIG. 6 area C, which meshes with the detail area E of FIG. 7, it is seen that the channel score 101 is slightly offset and isolated from the projected continuation of ridge scores 103 and 105. This offset is preferably about 1 to 2 thicknesses of the blank material or about 0.5 to 2.0 mm. Similarly, FIG. 11 illustrates an enlarged detail of the FIG. 6 area D showing the die ridge 107 to be offset from the line of 103 but in a direction opposite from the offset direction of channel 101. FIG. 13 illustrates the pattern of channels 203, 207 and 209 (FIG. 7 detail area F) which mesh with the corresponding ridges 103, 107 and 109 of FIG. 11.

To further reduce folding stress at the package corners, proximate terminal ends of the adjacent, oppositely oriented scores are separated by about 3 to 6 thicknesses of blank material such as at the ends of ridges 103 and 111 from the ends of channel 101. Additionally, the male score ridge ends are radiused to provide a soft edge that will not compromise score line integrity. These male score line ends are located at about 1 mm from their theoretical point of intersection to prevent the occurrence of fracture lines between adjacent score line ends. The unscored area between score line ends provides a point to relieve pressure during folding operations.

The direction of offset and scoring bias of the discontinuous score elements 101/201 and 107/207 are additionally significant features of the present invention. In the presently described preferred embodiment of the invention, die channels 101 will provide score lines 61 on the package blank of FIG. 14 which form top side corners to the top panel face 40. Projecting integrally from these corners 61 is a triangular gable 41 formed by the fold of excess side material about the diagonal scores 63 and the inside corner scores 94 and 95. To avoid a loose, triangular appendage from the finished package product, this triangular gable 41 may be folded flat against either the top panel 40 or the respective side walls 12 and 13. The direction of score line 61 offset is determined by the surface selected for flat attachment. If folded and glued against the side wall surfaces as shown by FIG. 1, the score line 61 offset will be in the direction of the outer perimeter edge. If gable 41 is to be folded and glued flat against the top panel 40, the score line 61 will be offset from the projected continuity of score lines 50 and 55 in the direction away from the outer perimeter edge. Although the top side edges 61 are outside corners, the score line 61 is embossed with the score channel concavity facing the package outside, contrary to most of the other score line bias.

The same score bias analogy is applied to the offset of bottom side corner score lines 71. It will be noted from the projected development of FIGS. 6 and 7 and the detail of FIG. 11 that corner score 71 is embossed by a die ridge 107 to provide an inside facing concavity which, if consistent with the bias of scores 103 and 105, would be appropriate for an outside corner. In this preferred embodiment, however, the triangular ears formed by the folding of excess end material about the diagonals 73 and bottom side corners 91 is hinged about score line 71 as an inside corner, laid flat against bottom end face 15 and adhesively secured.

Referring again to FIGS. 16 and 17, the web 139 next proceeds to the sterilization section of the machine 140 where applicator roll 141 applies a hydrogen peroxide solution to the product contact surfaces of the web. From the hydrogen peroxide application, the web is guided over idler roll 142 into tight contact with the surface of heated sterilization drum 145. A free-floating dancer roll 146 controls the arc length of contract with the drum 145 and hence, the contact time of the web on the drum. Hot water within the drum is heated to about 85° C. and the web is held in contact with the drum surface about eight seconds. The interaction of hydrogen peroxide and heated drum surface provides highly effective sterilization achieving spore kill ratios on the order of $10^6$ to $10^7$. Also, evaporation to the sterile air as the web progresses up the folding tower 150 eliminates virtually all hydrogen peroxide residuals remaining from the web sterilization process.

Web advancement up to and around the sterilization drum 145 has been substantially continuous. From the sterilization drum 145, the web advances intermittently into the folding tower 150 to be formed into a tent shape while web sterility is maintained by a positive pressure flow of sterile air surrounding the folding tower, crown, filling and sealing areas. Dancer roll 146 functions as a constant tension spring on the web as it leaves the drum 145 continuously but rises with intermittent motion to the crown rolls 152. Accordingly, when there is no web movement over the crown rolls 152, dancer roll 146 maintains the web tension against the rolls 152 and sterilization drum 145 by positionally yielding with the drum 145 web payout.

The intermittently forming tent in the folding section 150 is closed about the centerfold score line 60 and creased by a creasing roller set 151. Traveling downward from the pair of crown rolls 152, the folded but open edge web is enclosed within a chamber not shown wherein a constant pressure of sterile air is maintained. One fluid conduit 156 and one sterile air conduit 154 penetrate the opening between the juxtaposed web edges and continue, structurally, downward below the penetration point for several inches before termination. Along the juxtaposed web edges that correspond to the finished carton bottom end flange edge 25/35, at a point shortly below the fluid conduit penetration point between the folded web leaves but above the conduit termination level, is a flange inductive sealing element 158. Below the inductive sealing element 158, the folded material traveling continuum of the web is a fluid tight tube containing a standing column of sterile liquid product delivered by conduit 156 in the presence of sterile air delivered by conduit 154.

The product delivery system comprises a product valve 161 and a package fill valve 163. The product valve 161 controls the flow of product from the product processing system not shown to the fill control system. The package fill valve 163 is a modulating valve which is continuously opening and closing to provide a substantially constant flow of product into the tube. A volume control mechanism not shown indirectly senses the amount of liquid product in the tube and controls the operation of the fill valve to maintain proper product level.

A registration mark sensor 165 transmits positional data from a preprinted register bar on the web to adjust the stroke of a gripper mechanism 170 which pulls the web, incrementally, through the machine with a reciprocating movement. The gripper 170 pulls the web one package width, releases, returns and grips to begin again.

From the gripper mechanism, the web enters a gate assembly that functions to help regulate the volumetric contents of a developing carton as well as to control the web movement into subsequent preformer, transverse sealer and knife.

A preformer assembly 174 engages the product filled tube along the side score lines thereby defining the package geometry, beginning the forming process and determining the product volume in each package. Additionally, the preformer positions the package that is about to be cut off by 176.

While juxtaposed side flanges are pinched together by the sealing device 172, the mutually contacting inside polymer coatings are softened by the laminated aluminum foil which is heated by current induction conducted by the aluminum foil laminae. This inductive heat is conducted under the pinch pressure of the sealing bars 172 thereby fusing the respective flanges together to complete the closure of one package and to simultaneously seal the bottom of the downrunning, fluid filled tube.

Herewith is a completely filled and enclosed package of liquid contents in the shape of an asymmetric pillow as shown by FIG. 5 but still attached to the paper tube continuum. As the tube indexes, the sealed pillow is severed along the middle of the induction seal from the paper tube continuum above by the cutoff knife 176 to drop into the forming section 180.

The forming section 180 comprises a pocket conveyor 182, a forming arch 184 and two tab sealing towers 186, only one of which is illustrated for clarity. The conveyor 182 advances the package to the forming arch 184 which completes the parallelepiped erection to form the triangular gable points into flat appendages while the sides 12 and 13 and ends 14 and 15 are pushed to a position normal to the front and back face panels 20 and 30, respectively. In the process, standing bottom flange 25/35 is folded about either score line 49 or 59 into flat alignment with the respective bottom half panel 22 or 32 and secured. With the side and end panels normal to the front and back panels, the top gable points 41 are collapsed about diagonal scores 63 and pointed in parallel with the side wall planes 12 and 13. Similarly, the bottom end points 48 are collapsed about diagonal score lines 73 and 77 and also into alignment with the side wall planes 12 and 13. Standing flange 24/34 is now in a straight line and can be folded about either score line 53 or 58 flat with the corresponding half panel 21 or 31.

From this disposition, any of the four gable points may be folded in either of two directions into adjacent parallelism with either an end plane or a side plane. At the tab sealing towers 186, heat is applied to the gable points and the package body. The gable point sealing mechanisms fold the tabs along the sides and bottom of the package, holding them in place until they are bonded. However, due to the offset of score 61, gable point 41 is biased to fold with the least resistance and stress into parallel alignment with the half side panels 21/31. For the same reason, bottom end points 48 are biased by offset scores 71 and 75 to fold with the least resistance into parallel alignment with the bottom plane half panels 22 and 32.

Either folding direction of the gable points has respective advantages. The preferred embodiment described herein was selected to take maximum advantage of the uninterrupted surface area of top end panel 40 in continuity with the uninterrupted surface areas 20 and 30 respective to the package front and back faces. This relative expanse of clear surface area provides considerable flexibility for advertising, information, graphic attractions and aesthetics.

Having fully described our invention:

We claim:

1. An apparatus for scoring paperboard sheet comprising first and second elongate rotary die cylinders secured to respective first and second rotating axle shafts, said cylinders having mutually meshing scoring elements disposed in lines alone surfaces respective to said first and second cylinders substantially parallel with said axle shafts to rotatively nip an indefinite length of paperboard traveling in a machine direction therebetween, said scoring elements including a mix of first and second gender elongate scoring elements comprising at least one male and one female scoring element each of which extends only partially across the length of the cylinder surface wherein said male and female scoring elements have ends in spaced-apart proximity with one another and a corresponding mix of opposite gender scoring elements disposed on said second cylinder for meshing with the mix of scoring elements on said first cylinder.

2. An apparatus for scoring paperboard sheet as described by claim 1 comprising a pair of substantially parallel line scoring elements aligned substantially transverse of said machine direction, a first line of said parallel scoring elements being of a first gender and the second line of said scoring elements being of a mixed gender having a segment of offset alignment.

3. An apparatus for scoring paperboard sheet as described by claim 2 wherein said second line segment of offset alignment is of said first gender and adjacent second line elements being of a second gender.

4. An apparatus for scoring paperboard sheet as described by claim 3 wherein said scoring segment of offset alignment is linked to said first scoring element line by a pair of diagonally directed second gender elements in triangular configuration wherein terminal ends of said offset and diagonally directed element have neither intersection nor junction.

5. An apparatus for scoring paperboard sheet as described by claim 1 including register control means for coordinating the mesh location of scoring die elements along said length of paperboard, said scoring die cylinders having arcuate segments of respective cylinder surface perimeter that are without transverse scoring die elements continuously along the axial length of said cylinder.

6. A method of scoring an elongate paperboard web to make a series of package blanks, said method comprising the steps of drawing a paperboard web of finite width and indefinite length along a machine action of fiber orientation through a nip between a first pair of mutually meshing rotary scoring dies for forming a plurality of elongated score line channel increments aligned substantially transversely of said machine direction in a broken continuity substantially across the full web width with an end of a channel increment respective to a first portion of the web width opening on one side of said web disposed in closely spaced proximity with the end of an adjacent channel increment respective to a second portion of the web width opening on an opposite side of said web.

7. A method of scoring a paperboard blank as described by claim 6 wherein continuous score line channels respective to opposite web surfaces formed along directions parallel with said web machine direction are formed by a second pair of rotary scoring dies.

8. A method of scoring a paperboard blank as described by claim 7 wherein at least a portion of score line channels aligned in directions oblique to said machine direction are terminated without junction with other score line channels that are transverse to said machine direction.

9. A method of scoring a paperboard blank as described by claim 6 having more than one pair of scoring dies cooperatively driven in register alignment wherein substantially no concave score line channels having a length component transverse to said machine direction is formed in said web within register correction increments of a rotational perimeter respective to said first pair of scoring dies.

10. A method of scoring a paperboard blank as described by claim 9 wherein score line channels respective to said opposite web surfaces formed along directions parallel with said web machine direction are formed by said second pair of rotary scoring dies prior to formation of score line channels formed by said first pair of scoring dies.

11. A method of making a series of discrete package blanks on an elongate paperboard web which comprises advancing the web lengthwise through the nip of a pair of rotary scoring dies, each having an arrangement of elongate male and female pattern elements wherein said scoring dies are arranged to dispose male elements on one die with female elements on the other die substantially in intermeshing relation during rotation of the scoring dies, at least a portion of the male and female pattern elements being disposed obliquely relative to the length of the web, thereby providing a series of discrete scored package blanks each of which includes fold lines biased to encourage folding in opposite directions from the plane of the blanks.

12. The method of claim 11 wherein a plurality of blanks are provided for each rotation of the scoring dies.

13. The method of claim 11, wherein at least one of the scoring dies includes a female pattern element adjacent a male pattern element but off-set therefrom with terminal ends of each in closely spaced apart relation so that the resulting scored blank includes one fold line associated with the female element and another fold line associated with the male element and a region of substantially uninterrupted surface extending between respective adjacent ends of the fold lines associated with the terminal ends of the female and male pattern elements.

14. The method of claim 13 wherein the female pattern element and the adjacent male pattern element are disposed in substantially parallel relation.

* * * * *

UNITED STATES PATENT AND TRADEMARK OFFICE

CERTIFICATE OF CORRECTION

PATENT NO. : 5,704,886

DATED : January 6, 1998

INVENTOR(S) : Guido Sampaolo et al

It is certified that error appears in the above-indentified patent and that said Letters Patent is hereby corrected as shown below:

Item [57]

IN THE ABSTRACT:

Line 1, change "area" to -- areas --.

Line 12, after "sealing" delete -- , --.

Column 3, line 40, delete "direction" and insert -- directions --.

Column 4, line 43, after "adjacent" insert -- , --.

Column 5, line 16, after "for" insert -- the --.

Column 5, line 26, after "place." delete "The" and insert -- Also, the --.

Column 6, line 29, after "120" insert -- , --.

UNITED STATES PATENT AND TRADEMARK OFFICE

CERTIFICATE OF CORRECTION

PATENT NO. : 5,704,886

DATED : January 6, 1998

INVENTOR(S) : Guido Sampaolo et al

It is certified that error appears in the above-indentified patent and that said Letters Patent is hereby corrected as shown below:

Column 7, line 40, delete "mashing" and insert -- meshing --.

In the Claims:

Column 12, Claim 6, line 7, delete "action" and insert -- direction --.

Signed and Sealed this

Twenty-first Day of April, 1998

Bruce Lehman

*Attest:*

BRUCE LEHMAN

*Attesting Officer*

*Commissioner of Patents and Trademarks*